US006508625B1

(12) United States Patent
Hoppenz et al.

(10) Patent No.: US 6,508,625 B1
(45) Date of Patent: Jan. 21, 2003

(54) COOLING-WATER PUMP AND METHOD FOR ITS PRODUCTION

(75) Inventors: Andreas Hoppenz, Offenbach (DE); Dirk Steding, Altenstadt (DE)

(73) Assignee: Siemens Aktiengesellschaft, Munich (DE)

( * ) Notice: Subject to any disclaimer, the term of this patent is extended or adjusted under 35 U.S.C. 154(b) by 223 days.

(21) Appl. No.: 09/663,588

(22) Filed: Sep. 18, 2000

Related U.S. Application Data

(63) Continuation of application No. PCT/DE99/00576, filed on Mar. 4, 1999.

(30) Foreign Application Priority Data

Mar. 17, 1998 (DE) ..... 198 11 598

(51) Int. Cl.[7] ..... F04D 29/92; F04D 29/02
(52) U.S. Cl. ..... 415/200; 415/915; 29/888.024
(58) Field of Search ..... 415/200, 204, 415/205, 206, 915; 29/888.02, 888.024

(56) References Cited

U.S. PATENT DOCUMENTS 2,687,280 A * 8/1954 Sharp ..... 415/164
3,738,782 A 6/1973 Fraser
4,869,643 A * 9/1989 de Vries ..... 415/200
5,035,574 A * 7/1991 de Vries ..... 415/200
5,219,461 A 6/1993 Hyll et al.

FOREIGN PATENT DOCUMENTS

| | | |
|---|---|---|
| DE | 75 39 099 | 5/1976 |
| EP | 0 101 628 A1 | 2/1984 |
| FR | 2 563 872 | 11/1985 |

OTHER PUBLICATIONS

"Pumping Stations and Heavy Duty Raw Water Pumps" (Courcot et al.), dated 1993, GEC Alsthom Technical Review, N.12, pp. 31–46.
"Operating Problems of Pump Stations and Power Plants" (Bunjes et al.), dated Sep. 1982, XP–002106441, pp. 1–13.

* cited by examiner

*Primary Examiner*—Edward K. Look
*Assistant Examiner*—Igor Kershteyn
(74) *Attorney, Agent, or Firm*—Laurence A. Greenberg; Werner H. Stemer; Ralph E. Locher

(57) ABSTRACT

The object is, by simple measures, to ensure a particularly smooth inner surface and maintain particularly high dimensional accuracy of a pump housing of a cooling-water pump for a power plant. For this purpose, the cast-concrete pump housing of the cooling-water pump has, according to the invention, a number of formwork elements made of glass-fiber reinforced plastic.

5 Claims, 1 Drawing Sheet

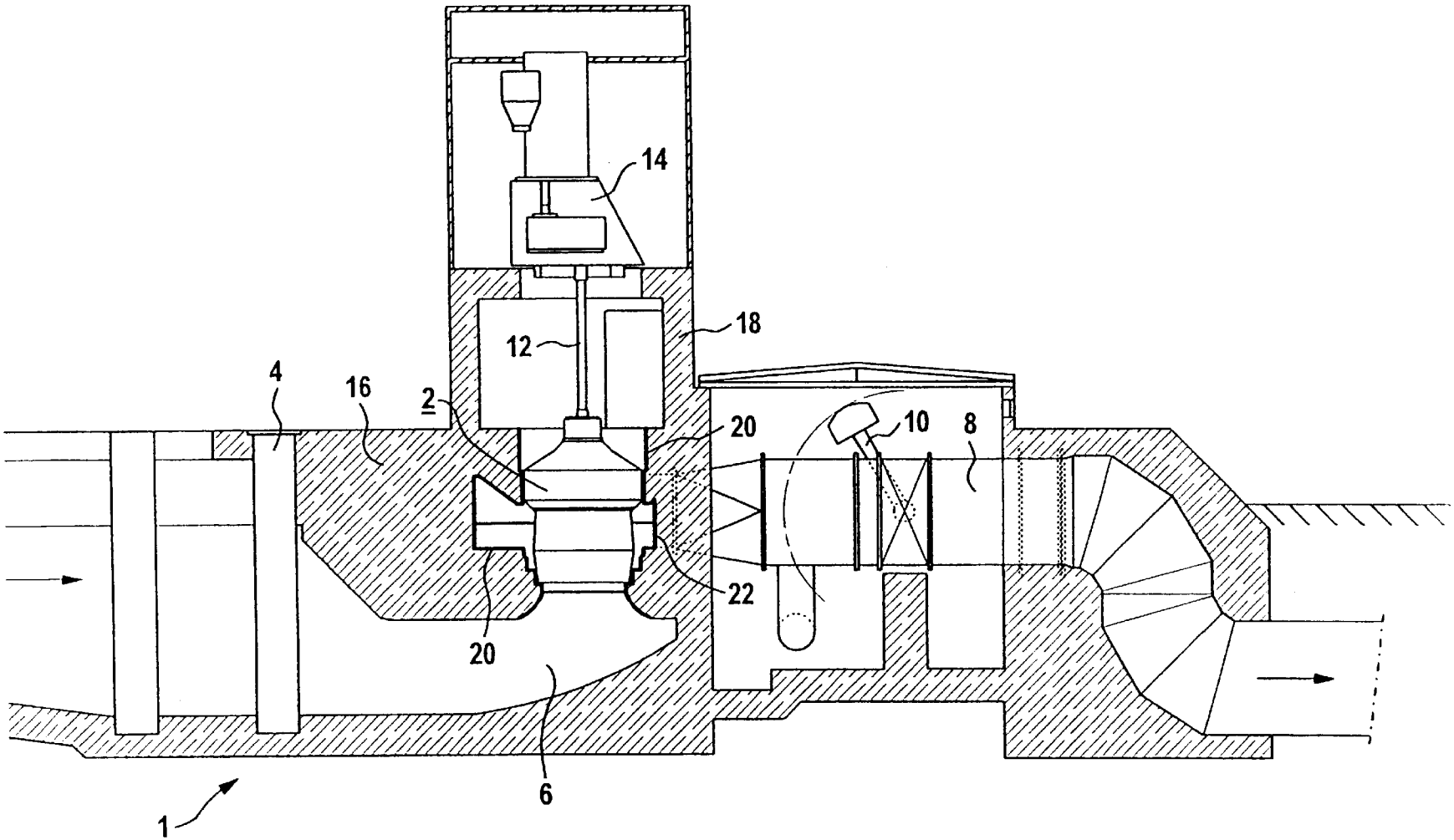
8
10
18
20
22
14
12
2
16
4
6
20
1

COOLING-WATER PUMP AND METHOD FOR ITS PRODUCTION

CROSS-REFERENCE TO RELATED APPLICATION

This is a continuation of copending International Application PCT/DE99/00576, filed Mar. 4, 1999, which designated the United States.

BACKGROUND OF THE INVENTION

Field of the Invention

The invention relates to a cooling-water pump for a power plant. It furthermore relates to a method for producing a cooling-water pump of this kind.

In a power plant, it is customary practice to provide a cooling-water system containing a number of cooling-water pumps. Owing to the quantities of cooling water to be pumped, these cooling-water pumps are generally embodied as very large-dimension components, it being possible, for example, for an impeller diameter of up to 1.80 m to be provided. Owing to the size of these components, cooling-water pumps are generally only assembled at the location of use. By virtue of the fact that assembly takes place only at the location of use, the housing of the cooling-water pumps can be cast from concrete.

A cooling-water pump of this kind with a cast-concrete pump housing is known, for example, from Published, European Patent Application EP 0 101 628 A1. With this known pump, which is in the form of a spiral concrete pump, the housing includes a preprepared thin-walled formwork wall made of reinforced concrete. As an alternative, the housing of a spiral concrete pump of this kind can, however, also be produced using a wooden formwork that is removed after the concrete housing has been cast.

Cooling-water pumps of this kind are subject to special requirements in regards to a smooth inner surface of the pump housing. In the case of the known cooling-water pumps, these requirements can only be met with a particularly high outlay. Moreover, it is only possible to maintain the required dimensional accuracy for the internal dimensions of the pump housing to a limited extent.

SUMMARY OF THE INVENTION

It is accordingly an object of the invention to provide a cooling-water pump and a method for its production which overcome the above-mentioned disadvantages of the prior art devices and methods of this general type, which has a particularly smooth inner surface and the maintenance of particularly high dimensional accuracy of the pump housing is ensured by simple measures.

With the foregoing and other objects in view there is provided, in accordance with the invention, a cooling-water pump for a power plant, containing a pump housing cast from concrete and a number of formwork elements made of a glass-fiber reinforced plastic.

As regards the cooling-water pump, the object is achieved, according to the invention, by a pump housing which is cast from concrete and has a number of formwork elements made of glass-fiber reinforced plastic.

Here, the invention is based on the consideration that a smooth inner surface for the housing and a high dimensional accuracy of the pump housing can be achieved by a special configuration of the formwork used in the production of the pump housing. The material used to produce the formwork, in particular, is very significant in this context. For this purpose, formwork elements made of glass-fiber reinforced plastic are provided.

The cooling-water pump is advantageously configured as a spiral concrete pump. In this context, the glass-fiber reinforced plastic formwork elements are expediently inserted in the region of a spiral housing of a spiral concrete pump.

Any desired glass-fiber reinforced plastic can be provided as the material to form the formwork elements. It advantageously contains glass fibers, quartz sand and a synthetic resin.

As regards the method for the production of the cooling-water pump, the object is achieved if a number of prepared formwork elements made of glass-fiber reinforced plastic are assembled at the set-up location of the cooling-water pump to resulting in a formwork which is a lost formwork when the concrete housing of the cooling-water pump is cast.

The glass-fiber reinforced plastic formwork elements can be molded by using standardized negative molds in their production.

In contrast to a conventional formwork, a lost formwork remains at the production site after the production of the respective concrete component and is firmly connected to the respective concrete component after its production. The glass-fiber reinforced plastic formwork elements used as lost formwork thus become integral parts of the concrete housing after the production of the latter. By virtue of the materials properties of glass-fiber reinforced plastic, the pump housing thus has a particularly smooth surface in the region of the formwork elements.

The advantages obtained with the invention are, in particular, that high dimensional accuracy and a particularly smooth inner surface can be achieved through the use of the lost formwork made of glass-fiber reinforced plastic in the production of the concrete housing of the cooling-water pump. The glass-fiber reinforced plastic formwork elements have a particularly high strength, with the result that there is virtually no deformation due to shrinkage or creep, as in the concrete itself, during the production of the concrete housing. Moreover, the entire inner surface of the pump housing, which is exposed to the cooling water flowing through the cooling-water pump, can be formed by the glass-fiber reinforced plastic formwork elements, with the result that it is particularly insensitive to corrosion or chemical attack or abrasion by the cooling water. Furthermore, the glass-fiber reinforced plastic formwork elements have a particularly low weight, making transportation of prepared formwork elements from the production site to the location of use of the cooling-water pump and also the assembly of the pump housing particularly simple.

Other features which are considered as characteristic for the invention are set forth in the appended claims.

Although the invention is illustrated and described herein as embodied in a cooling-water pump and a method for its production, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWINGS

The single FIGURE of the drawing is a diagrammatic, partial, sectional view of a pumping station of a cooling-water system for a power plant.

DESCRIPTION OF THE PREFERRED EMBODIMENTS

Referring now to the single FIGURE of the drawing, there is shown a pumping station 1 that is part of a cooling-water system of a power plant. The pumping station 1 contains a cooling-water pump 2, which, in accordance with its intended purpose, is configured for a comparatively high efficiency and for a comparatively low delivery head. Disposed upstream of the cooling-water pump 2 on the cooling-water side is an inlet chamber 6, which can be shut off by a bulkhead gate 4. In the exemplary embodiment, the inlet chamber 6 is configured in such a way that the cooling water flows to the cooling-water pump 2 in an approximately vertical main direction.

Disposed on an outlet side of the cooling-water pump 2 is a cooling-water duct 8, which can be shut off by a pivotably mounted non-return valve 10. The cooling-water duct 8 is constructed to allow the cooling water to flow out of the cooling-water pump 2 in an approximately horizontal main direction.

The cooling-water pump 2 contains a non-illustrated impeller, which can be driven by a motor and transmission unit 14 via a shaft 12. The cooling-water pump 2 is configured as a spiral concrete pump, the impeller being disposed in an interior of approximately spiral configuration, also referred to as a "spiral". The shaft 12 is disposed approximately vertically, with the result that the cooling water flows in an approximately axial direction to the impeller during the operation of the cooling-water pump 2 and emerges approximately tangentially from the spiral.

The dimensioning of the main components of the pumping station 1, in particular the dimensions of the impeller of the cooling-water pump 2 and the power of the motor and transmission unit 14, depend on the requirements of the power plant. In the exemplary embodiment, an impeller with a diameter of about 1.80 m is provided.

The cooling-water pump 2 has a cast-concrete pump housing 16, on which retaining structures 18 for the motor and transmission unit 14 are also disposed. The inlet chamber 6 and the cooling-water duct 8 also have cast-concrete duct walls.

The pump housing 16 of the cooling-water pump 2 has a number of formwork elements 20 made of glass-fiber reinforced plastic. The formwork elements 20 are disposed as a lost formwork to form an inner surface 22 of the pump housing 16.

The glass-fiber reinforced plastic provided to form the formwork elements 20 contains glass fibers, quartz sand and a synthetic resin. When a material of this kind is used, the pump housing 16 has a particularly smooth inner surface 22 and furthermore has particularly high dimensional accuracy. The inner surface 22 of the pump housing 16 is furthermore particularly insensitive to corrosion or chemical attack and/or abrasion.

In the production of the pump housing 16, the formwork elements 20 are produced first in advance. This advance production can be accomplished by molding on negatives at a central production location. From the production location, the preprepared formwork elements 20 are then transported to the location at which the cooling-water pump 2 is to be used. The low weight of the glass-fiber reinforced plastic formwork elements 20, in particular, result in that such transportation is particularly simple, even over long distances. At the location at which the cooling-water pump 2 is to be set up, the prepared formwork elements 20 are assembled to form a formwork that forms the subsequent inner surface 22 of the cooling-water pump 2. After the addition to the formwork 20, if appropriate, of further formwork elements, which can, for example, be provided to form the inlet chamber 6, the pump housing 16 is cast in concrete. During the casting of the pump housing 16, the formwork formed by the preprepared formwork elements 20 serves as a lost formwork. In other words: the formwork formed by the prepared formwork elements 20 remains in the pump housing 16 after the pump housing 16 has been cast and thus forms the inner surface 22.

The use of glass-fiber reinforced plastic to form the formwork elements 20 ensures that the inner surface 22 of the pump housing 16 is particularly smooth. The glass-fiber reinforced plastic formwork elements 20 furthermore make advance production and transportation from the location of production to the location at which the cooling-water pump 2 is to be set up particularly simple. The assembly of the cooling-water pump 2 is also made especially simple by the greater ease of handling of the formwork elements 20.

We claim:

1. A cooling-water pump for a power plant, comprising:

a pump housing cast from concrete and having a number of formwork elements made of a glass-fiber reinforced plastic.

2. The cooling-water pump according to claim 1, wherein said pump housing is a spiral-shaped concrete pump housing.

3. The cooling-water pump according to claim 1, wherein said glass-fiber reinforced plastic forming said formwork elements contains glass fibers, quartz sand, and a synthetic resin.

4. A method for producing a cooling-water pump, which comprises the step of:

assembling a number of prepared formwork elements made of a glass-fiber reinforced plastic at a set-up location of the cooling-water pump resulting in formwork used as a lost formwork when a concrete housing of the cooling-water pump is cast.

5. A method for producing a cooling-water pump, which comprises the step of:

forming a number of prepared formwork elements formed of a glass-fiber reinforced plastic;

assembling the number of prepared formwork elements at a set-up location resulting in a housing formwork; and casting a concrete housing using the housing formwork and the housing formwork being a lost housing formwork forming an interior wall of the concrete housing.

* * * * *